US006860727B2

(12) United States Patent
Huang

(10) Patent No.: US 6,860,727 B2
(45) Date of Patent: Mar. 1, 2005

(54) AIR ACTUATED HYDRAULIC PUMP

(75) Inventor: Jeng-Shiung Huang, Chia Yi Hsien (TW)

(73) Assignee: Tai Lio Enterprise Co., Ltd., Chia Yi Hsien (TW)

( * ) Notice: Subject to any disclaimer, the term of this patent is extended or adjusted under 35 U.S.C. 154(b) by 58 days.

(21) Appl. No.: 10/316,924

(22) Filed: Dec. 12, 2002

(65) Prior Publication Data

US 2004/0115069 A1 Jun. 17, 2004

(51) Int. Cl.[7] ..... F04B 35/04; F01L 25/04

(52) U.S. Cl. ..... 417/401; 417/440; 91/290; 91/303; 91/341 R

(58) Field of Search ..... 417/401, 440, 417/552, 402, 435, 545; 251/325, 319; 91/290, 303, 341 R

(56) References Cited

U.S. PATENT DOCUMENTS 3,041,975 A * 7/1962 Johnston et al. ..... 417/401
3,578,285 A * 5/1971 Carlton ..... 251/325
3,597,121 A * 8/1971 McClocklin ..... 417/400
3,788,781 A * 1/1974 McClocklin ..... 417/401
4,074,612 A * 2/1978 Miller ..... 91/290
6,415,704 B1 * 7/2002 Wang ..... 417/401

* cited by examiner

*Primary Examiner*—Charles G. Freay
(74) *Attorney, Agent, or Firm*—Rosenberg, Klein & Lee

(57) ABSTRACT

A hydraulic pump is equipped with an air motor, which is disposed in a housing and oil reservoir of the hydraulic pump, connected to an air source, and has a piston movable in a tube so that pressured air from the air source can cause reciprocation the a piston to pump hydraulic oil to other equipments such as a jack. The air actuated hydraulic pump is equipped with a pilot operated guided poppet valve comprised of several parts in separable connection, and a muffler so that the user doesn't have to replace the whole piston with a new one if only one of the parts is damaged, and that noise can be reduced when the pump is working.

3 Claims, 10 Drawing Sheets

AIR ACTUATED HYDRAULIC PUMP

BACKGROUND OF THE INVENTION

1. Field of the Invention

The present invention relates to an air actuated hydraulic pump, more particularly an air actuated hydraulic pump, which is equipped with elongated air passages, a manually operated vent valve assembly, and a pilot operated guided poppet valve comprised of several parts in detachable connection, and which is structured so that noise is reduced when working.

2. Brief Description of the Prior Art

Hydraulic jacks are used for raising objects to be repaired and maintained. Early hydraulic jacks need to be operated with hands moving a lever or feet pressing a pedal therefore the objects are raised at relatively low speed and the operation costs a lot of labor; hydraulic oil is released to lower the lifted objects.

Other conventional hydraulic jacks, such as are disclosed in Taiwan Patent no. 79213367 and no. 80210290, are equipped with an air motor so that hydraulic oil can be pumped with pressured air causing reciprocation of a piston. However, conduits have to be provided in the air motors for air communication of one room with another, causing trouble in manufacturing and assembling. And, such conduits are prone to be damaged, and need repair, which would also cost relatively much labor.

Taiwan Patent no. 82201954 disclosed an air actuated hydraulic jack to overcome the above disadvantages to the conduits of the air motor. However, this jack is found to have disadvantages as followings:

1. Two opposing air passage grooves are formed on an inner side of a tube, within which a piston of the air motor is moved, by means of striking the inner side of the tube with pressing machines. The shaping process is difficult to carry out because the direction of striking is from inside of the tube to outside.
2. The roundness of the tube will be changed due to the shaping process, badly affecting the performance of the air motor.
3. The air motor is equipped with a piston, which is comprised of parts inseparably connected together. Therefore, the whole piston has to be replaced with a new one even if only one of the parts is damaged or has worn down, making maintenance cost a burden on the user.
4. The air motor is not equipped with a vent valve assembly, and will produce loud noise when working.

SUMMARY OF THE INVENTION

It is a main object of the present invention to provide an air actuated hydraulic pump, which is equipped with a pilot operated guided poppet valve comprised of several parts in separable connection for easy repair and maintenance.

It is another object of the present invention to provide a manually operated vent valve assembly to the air actuated hydraulic pump, which is convenient to use.

It is yet another object of the present invention to form elongated air passage grooves on an inner side of a tube, within which a piston of the air actuated hydraulic pump is moved, in such a way that roundness of the tube will remain.

It is still another object of the present invention to provide a muffler to the air actuated hydraulic pump so that noise can be effectively reduced when the pump is working.

BRIEF DESCRIPTION OF THE DRAWINGS

The present invention will be better understood by reference to the accompanying drawings, wherein.

DETAILED DESCRIPTION OF THE PREFERRED EMBODIMENTS

Figure 1:
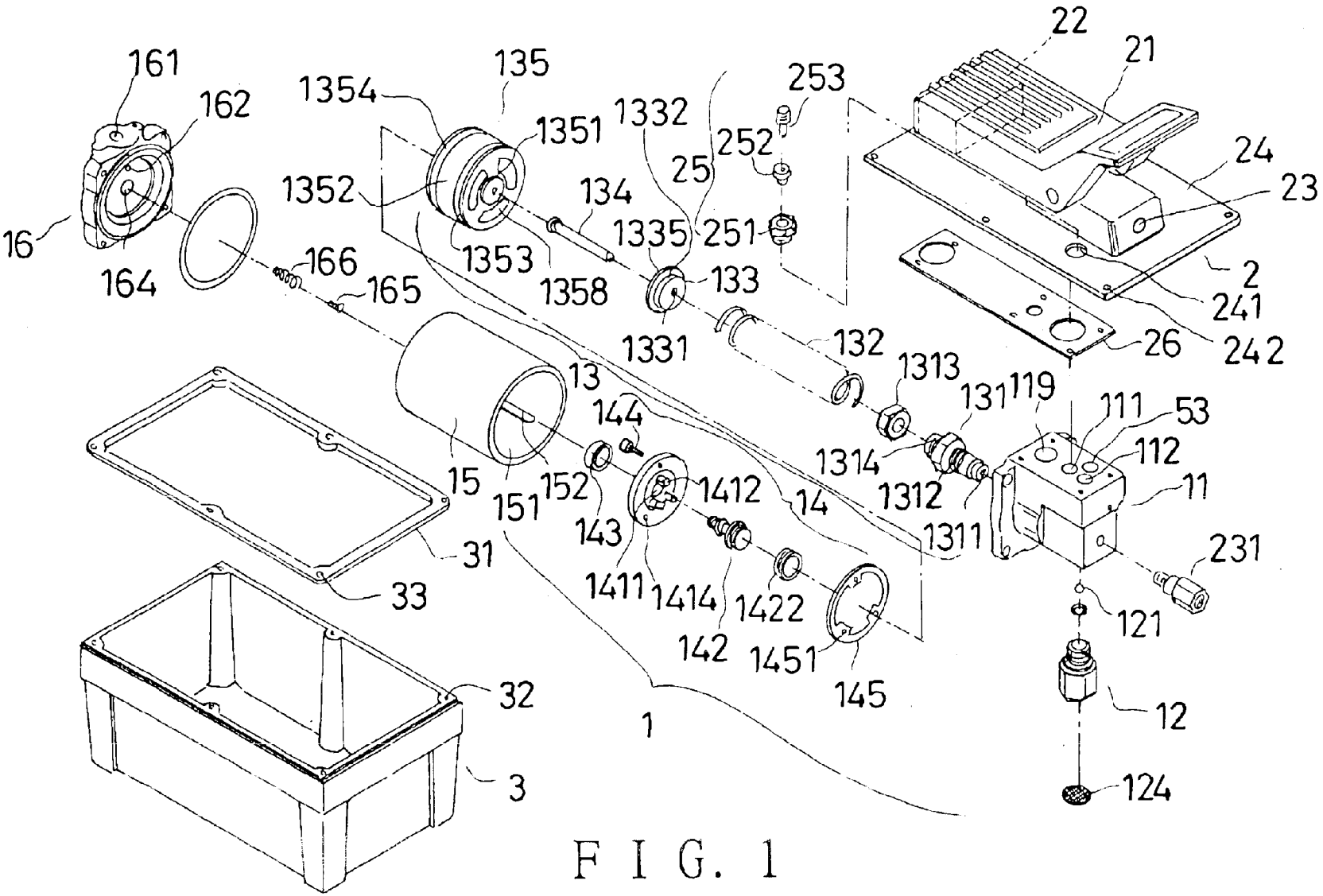
FIG. 1 is an exploded perspective view of the air actuated hydraulic pump according to the present invention.
Figure 2:
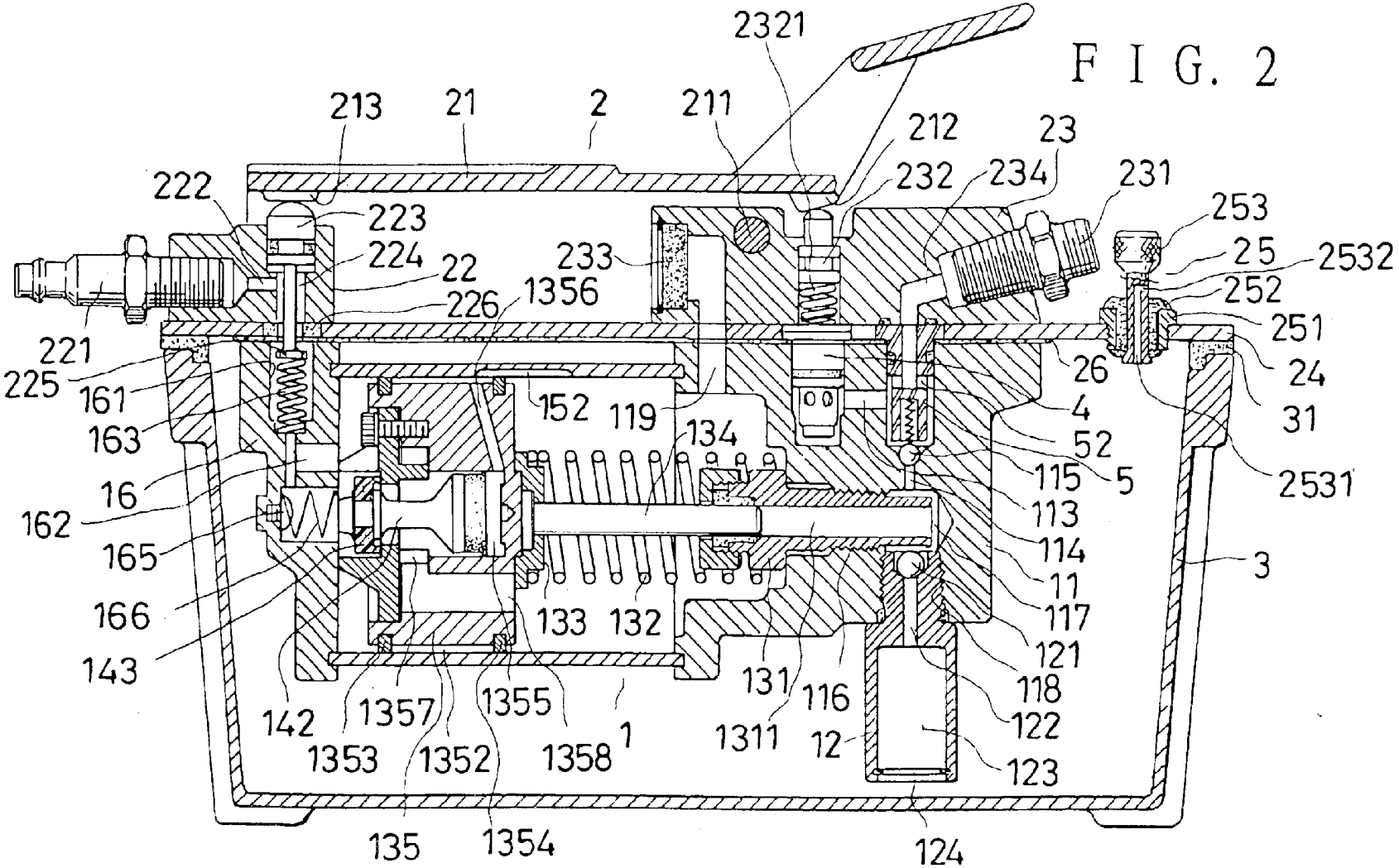
FIG. 2 is a cross-sectional view of the air actuated hydraulic pump according to the present invention.

Referring to FIGS. 1, and 2, a hydraulic pump made according to the invention includes a housing and oil reservoir 3, an air motor 1, a manual actuator 2, and a hydraulic pump, which is disposed adjacent to the right of the air motor 1.

The air motor 1 includes a front casting 11, a ball valve member 12, a piston assembly 13, a pilot operated guided poppet valve 14, a tube 15, and a rear casting 16.

The front casting 11 includes a valve hole 111, a bore 112, a transverse hole 113 in communication with the valve hole 111 and the bore 112, and has a threaded bore 118 which receives a ball valve member 12. Disposed in the hole 111, and the bore 112 are a large poppet valve member 4, and a spring loaded check valve 5 respectively. There is a ball 115 provided over a through hole 114 formed under, and in communication with, the bore 112. There is a bore 117 formed in the casting, in communication with through hole 114, and provided with a threaded section 116. The bore 117 is in communication with the threaded bore 118. There is a ball valve member 12 screwed into the threaded bore 118. Disposed over the upper end of a straight hole 122 of the ball valve member 12 is a ball. Joined to a lower end of an enlarged hole 123 of the ball valve member 12 is a filtering net 124. The enlarged hole 123 has filter cotton (not shown) received therein. Furthermore, there is provided a straight through hole 119 on the front casting 11 to the left of the valve hole 111 and in communication with both the bore 117.

The piston assembly 13 includes a pump 131, a coil spring 132, a securing means 133, a pump piston 134, and a piston 135. There is a bore 1311 formed in the pump 131. And, there is a threaded section 1312 formed on the pump 131 for allowing the pump 131 to be screwed into the threaded section 116 in the bore 117 of the casting 11. Mounted on the other end of the pump 131 are a nut 1313 and a plastic sleeve 1314, which is provided for preventing leakage of air and gas through between the pump piston 134 and the bore 1311.

There is a tube 15 disposed adjacent to the rear casting 16. The piston 135 is slidably received in a central hole 151 of the tube 15. There are elongated air passages 152 formed on the inner side of the tube 15. The elongated air passage grooves 152 are formed by means of cutting with cutting machines.

There is a stepped hole 1331 formed on the inner side of the securing means 133, through which the pump piston 134 is passed. Inserted into the stepped hole 1331 is a projection 1351 formed on the left side of the piston 135. There is an annular recess 1332 formed on the left side of the securing means 133 to define a projection for keeping a corresponding end of the coil spring 132 in position. The coil spring 132 is positioned such as to bias the piston 135 towards the left side of the housing. There is an annular recess 1352 formed around the piston 135, and a left sealing means 1353 and a right sealing means 1354 spaced apart on two ends of the annular recess 1352 of the piston 135. A port 1356 is formed in the piston 135 to be in communication with both a room 1355 of the piston 135 and the annular recess 1352 of the piston 135. Formed on the other end of the room 1355 of the piston 135 is a bore 1357, which is in communication with a stream guiding chamber 1358.

Figure 3:
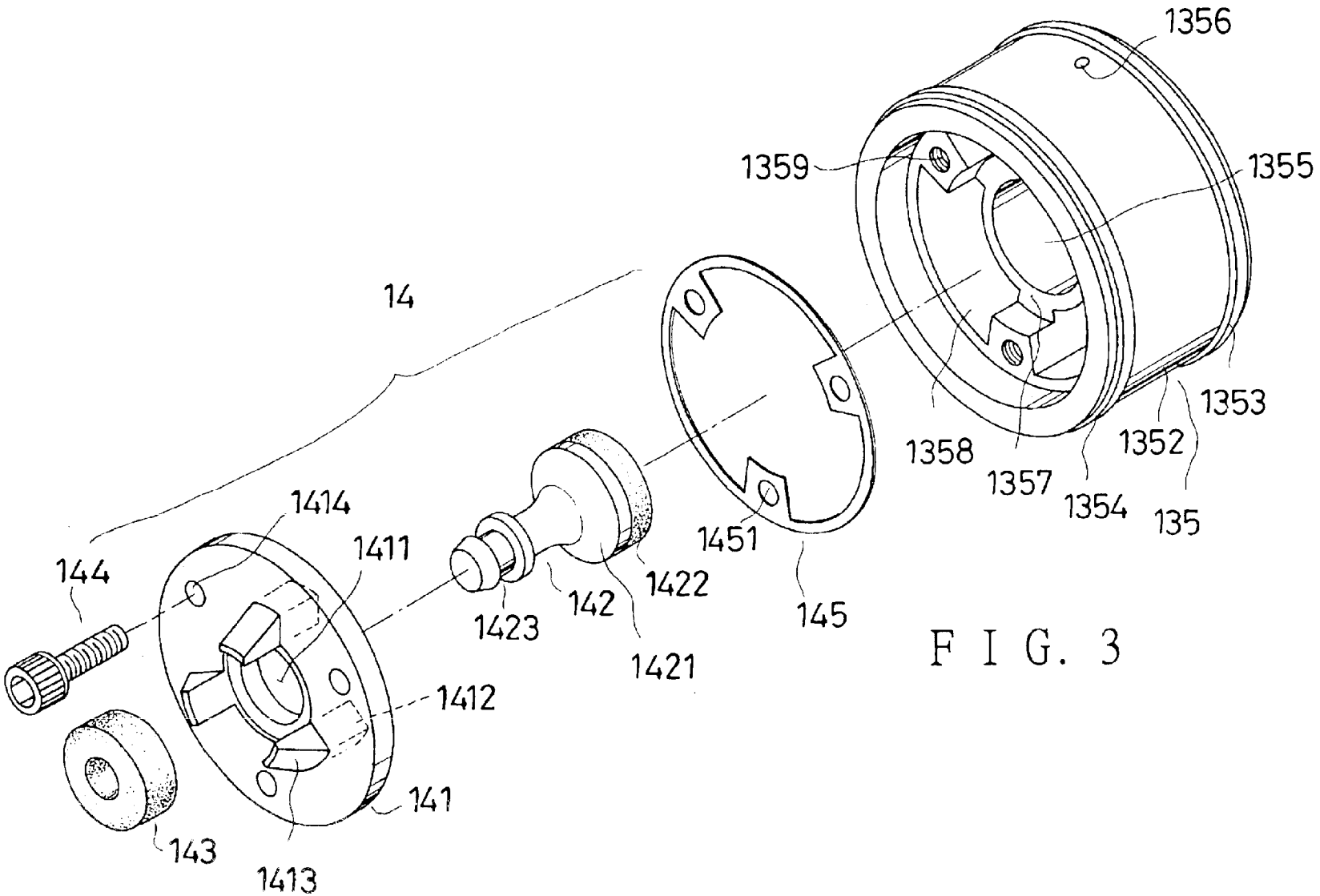
FIG. 3 is a fragmentary exploded perspective view of the air actuated hydraulic pump according to the present invention.

The pilot operated guided poppet valve 14, as shown in FIGS. 1, 2, and 3, includes a separating plate 141, a valve body 142, and an enlarged soft poppet 143, and a ring pad 145. There is a through hole 1411 formed on the separating plate 141 for the valve body 142 to be passed through. Front and rear projecting portions 1412, 1413 are formed around two ends of the through hole 1411 on the separating plate 141. A piston 1421 of one end of the valve body 142 is pressed against the front projecting portions 1412 of the separating plate 141, and a piston ring 1422 is mounted around the piston 1421. An annular recess 1423 is provided on the other end of the valve body 142, which the enlarged soft poppet 143 is fitted onto; the enlarged soft poppet 143 is secured to the rear projecting portions 1413 of the separating plate 141. Screws 144 are screwed through connecting holes 1414 of the separating plate 141, connecting holes 1451 of the ring pad 145, and screw holes 1359 of the piston 135 so that the separating plate 141, the ring pad 145, and the piston 135 are joined together.

An air inlet 161 and a conduit 162 in communication with the air inlet 161 are provided on the rear casting 16. Disposed in the air inlet 161 is a spring 163. Projecting from the conduit 162 of the rear casting 16 and secured in position by a screw 165 is a short spring 166.

The manual actuator 2 includes an upwards projecting handle 21, a air inlet base 22, an oil outlet base 23, a plate portion 24, and a vent assembly 25. The upwards projecting handle 21 is pivotally connected to the oil outlet base 23 by means of a pivotal pin 211. There are a front and a rear tongue 212, 213 formed on the upwards projecting handle 21.

Formed on the air inlet base 22 is an inlet 222, which is in communication with a conduit 224, in which a manually actuated valve member 223 is positioned. There is a source of air under pressure 221 connected to the inlet 222. A spring 163 is connected to a lower end of the manually actuated valve member 223 to bias the same upwards so that the same blocks a valve seat 226 with a valve element 225 thereof. When the manually actuated valve member 223 blocks the valve seat 226 so as to prevent air from traveling through the conduit into the rear casting 16, an upper end thereof sticks out from the air inlet base 22 to be able to be depressed by the rear tongue 213 of the upwards projecting handle 21.

An oil supplying connector 231 is joined to an outlet 234 of the oil outlet base 23, which is in communication with the spring loaded check valve 5. The oil outlet base 23 includes an plunger structure 232, and a muffler 233. There is a spring 2321 connected to a lower end of the plunger structure 232, and disposed above the large poppet valve member 4. The muffler 233 is disposed on the port 119 of the front casting 11. The oil outlet base 23 is fixedly disposed on the plate portion 24. Furthermore, the plate portion 24 is formed with a through hole 241. Fitted to the through hole 241 is a vent valve assembly 25, which includes a base 251, a connecting soft pad 252, and a pull rod 253. The base 251 is fixedly connected to the edge of the through hole 241. The connecting soft pad 252 is joined to the base 251. The pull rod 253 is movably passed through the connecting soft pad 252. Formed on the pull rod 253 are communicating holes 2531, and 2532 extending parallel to the long side of the pull rod 253 and extending to the lateral side of the pull rod 253 respectively. The vent valve assembly 25 can be pushed down manually to a blocking position where the hole 2532 is closed with the soft pad 252, and in turn, air is stopped from traveling into or out of the housing and oil reservoir 3, as shown in FIG. 4.

An leakage-prevention pad 31 is disposed on the upper end of the housing and oil reservoir 3. There are connecting holes 32, and 33 formed on the upper end of the housing and oil reservoir 3, and the leakage-prevention pad 31 respectively. The plate portion 24 of the manual actuator 2 is joined to the housing and oil reservoir 3 with screws being screwed through connecting holes 242 thereof and the connecting holes 32, and 33. A leakage-prevention pad 26 is disposed between the plate portion 24 and the air motor 1 for preventing oil from leaking the joint.

Figure 4:
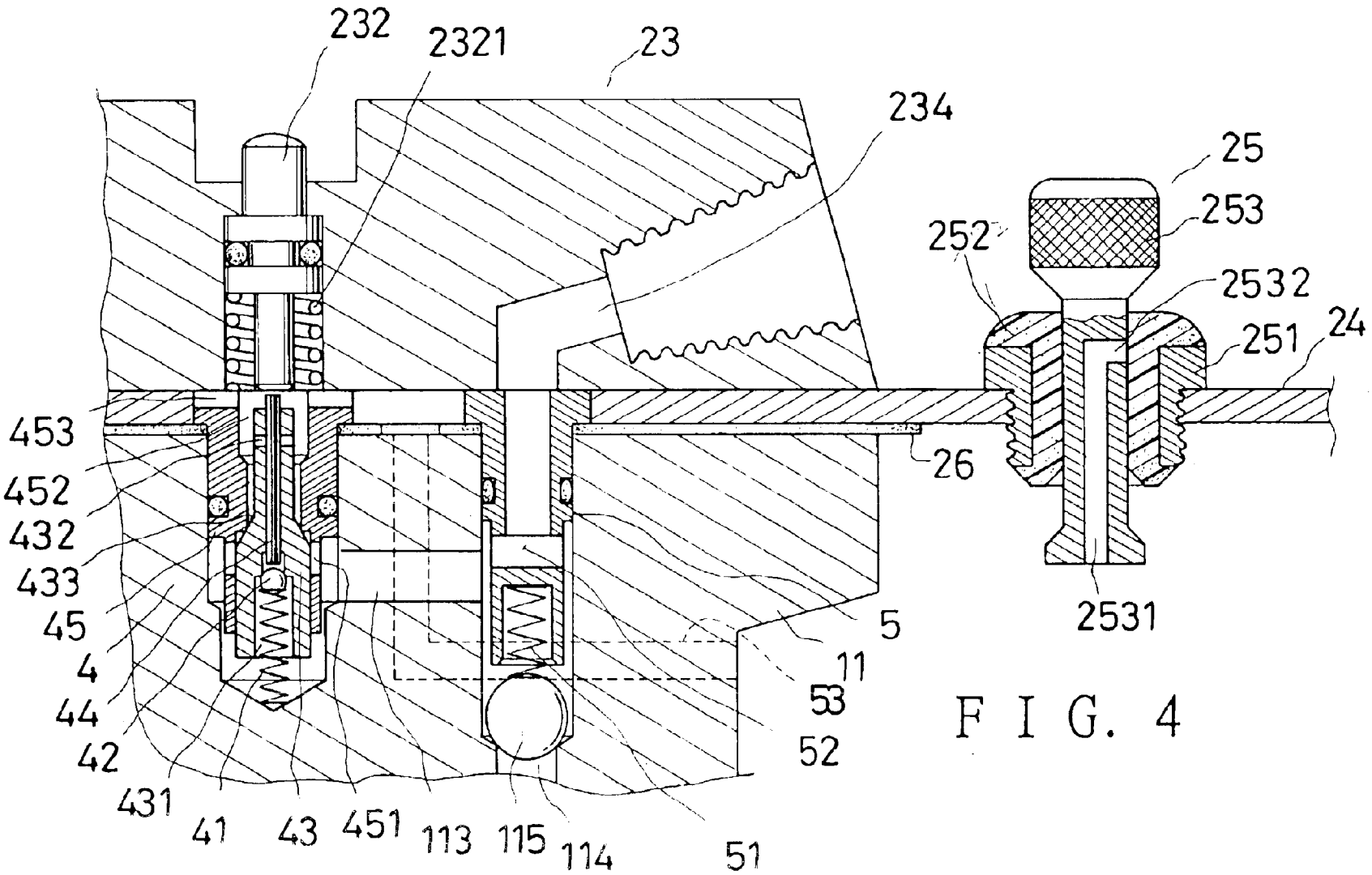
FIG. 4 is a partial cross-sectional view of the air actuated hydraulic pump according to the present invention.
Figure 5:
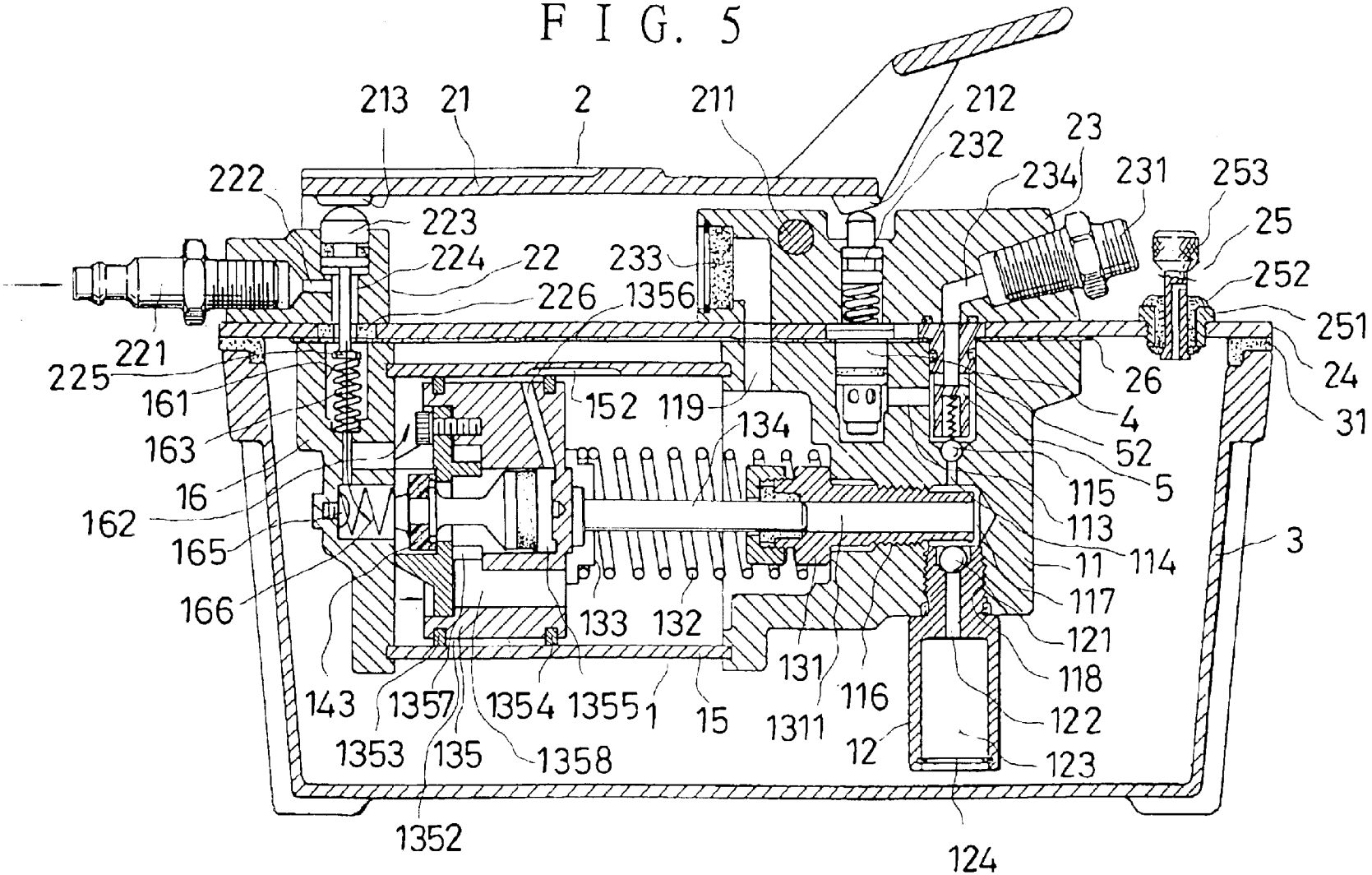
FIG. 5 is a cross-sectional view of the air actuated hydraulic pump working according to the present invention.
Figure 6:
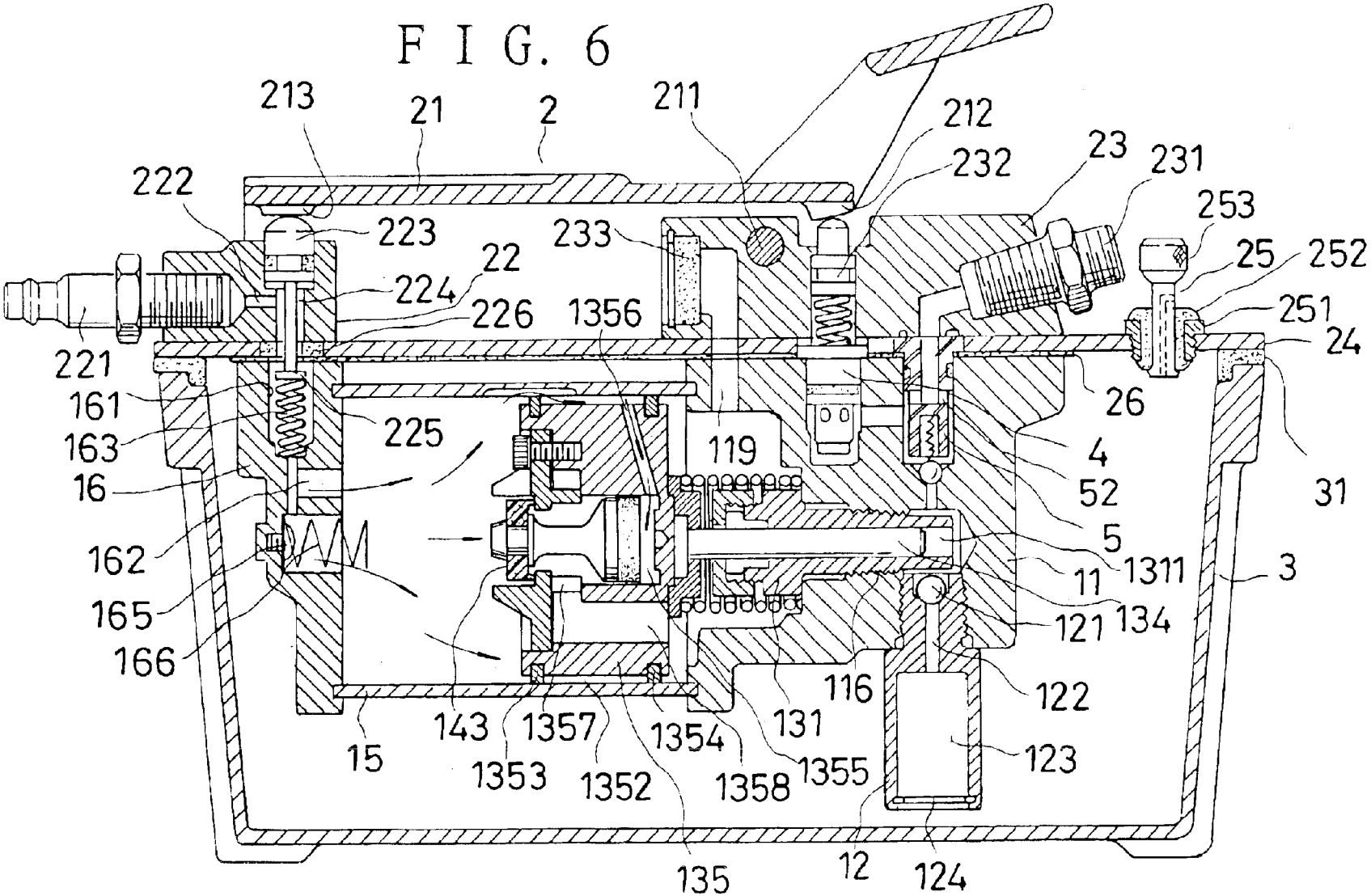
FIG. 6 is a cross-sectional view of the air actuated hydraulic pump working according to the present invention.
Figure 7:
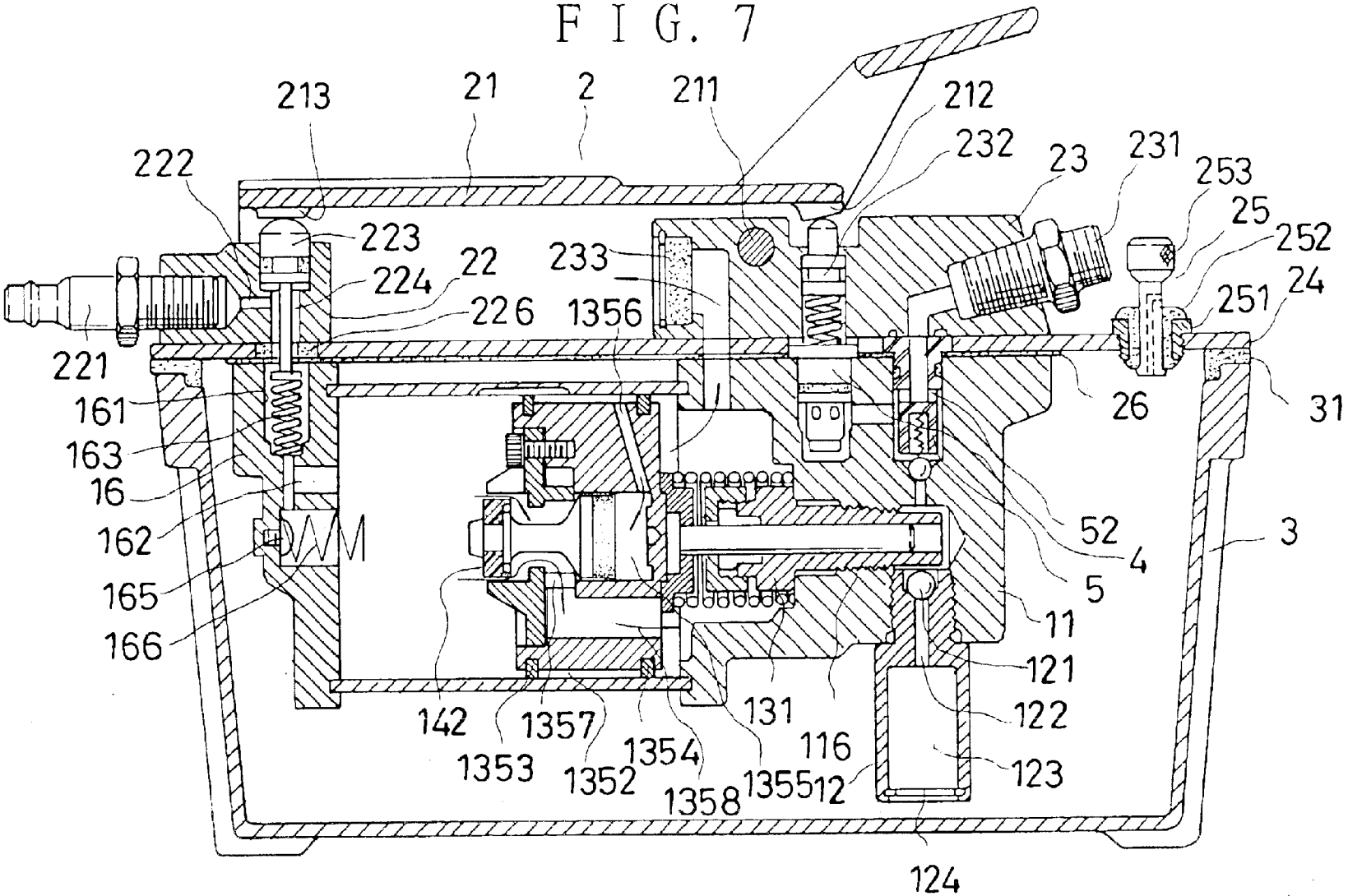
FIG. 7 is a cross-sectional view of the air actuated hydraulic pump working according to the present invention.
Figure 8:
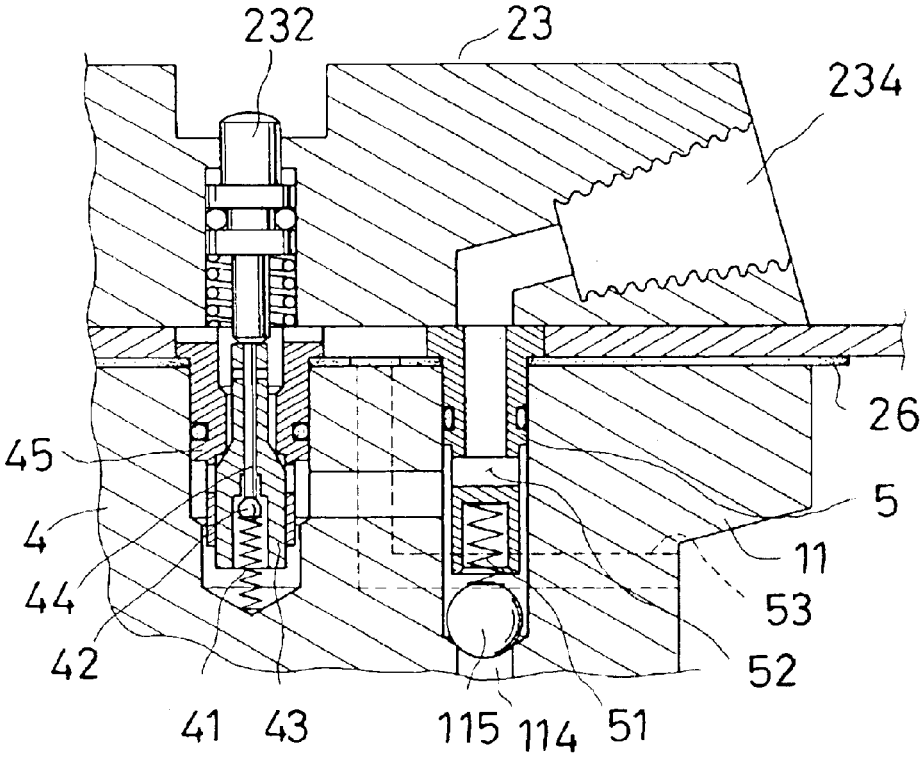
FIG. 8 is a partial cross-sectional view of the air actuated hydraulic pump working according to the present invention.
Figure 9:
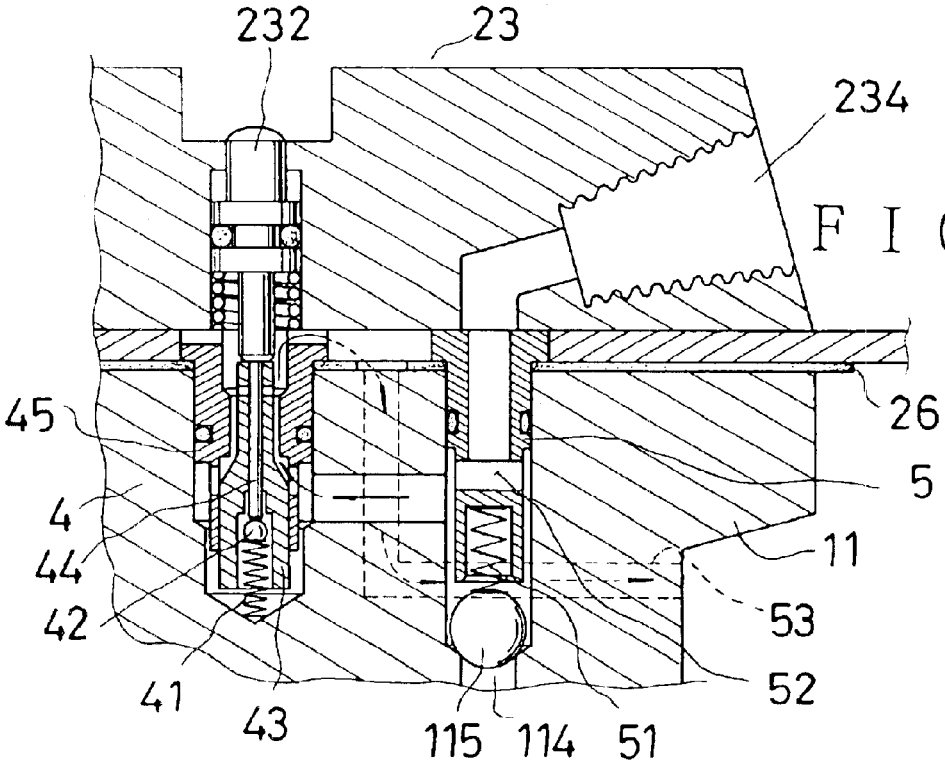
FIG. 9 is a partial cross-sectional view of the air actuated hydraulic pump working according to the present invention.

Referring to FIGS. 2, and 4, the large poppet valve member 4 includes a lower spring 41, a ball 42, a main rod 43, a valve seat member 45, and a second rod 44. The main rod 43 includes an enlarged end slidably received within a lower room of the valve seat member 45, and an upper end normally spaced from the lowest point of the plunger structure 232 when the latter is in its uppermost position. The main rod 43 has a frusto-conical sealing surface, which is adapted to sealing engage a stepped seat formation of the valve seat member 45. There are radially extending ports 451, holes 452, and recesses 453 formed on the valve seat member 45; oil can flow from the transverse hole 113 to the radially extending ports 451. The second rod 44 is passed through a central hole 431 of the main rod 43. The ball 42 is biased upwards to block the lower end of the central hole 431 of the main rod 43 by means of the spring 41. Thus, the main rod 43 is normally biased upwards by the spring 41 to prevent oil from flowing into an upper room of the valve seat member 45.

Furthermore, a conduit 53 is provided in communication with both the recesses 453 of the valve seat member 45 and the housing and oil reservoir 3.

The spring loaded check valve 5 has a passage 52 in communication with the transverse hole 113. A spring 51 of is disposed above a ball 115, which is disposed over the through hole 114, to normally bias the ball 115 downwards for the same to block the through hole 114.

Referring to FIGS. 5 to 9, when the manually actuated valve member 223 is depressed by means of the rear tongue 213 of the manual actuator 2, the valve element 225 no longer blocks the hole of the valve seat 226, and pressured air is pumped into the rear casting 16 via the air inlet 161 from the air source 221. The pressure air causes the piston 135 to move towards the front casting 11 against the force of the spring 132 until the left sealing means 1353 moves onto the elongated air passages 152 of the air tube 15. When the left sealing means 1353 moves onto the elongated air passages 152 of the air tube 15, pressured air will travel into the room 1355 of the piston 135 via the elongated air passages 152, the annular recess 1352, and the port 1356, and in turn, the pressured air pushes the valve body 142 towards the left side, and a space is formed connecting the bore 1357 of the piston 135 to the enlarged soft poppet 143, thus causing stop of leftward movement of the piston 135 that is effected by the pressured air. Consequently, the spring 132 urges the piston 135 to move towards the left side. Under such condition, pressure air travels into the tube 15 via the space connecting the bore 1357 of the piston 135 to the enlarged soft poppet 143 instead of via the elongated air passage grooves 152, and then travels through the muffler 233 to outside via the bore 1357, the stream guiding chamber 1358, and the straight through hole 119.

Figure 11:
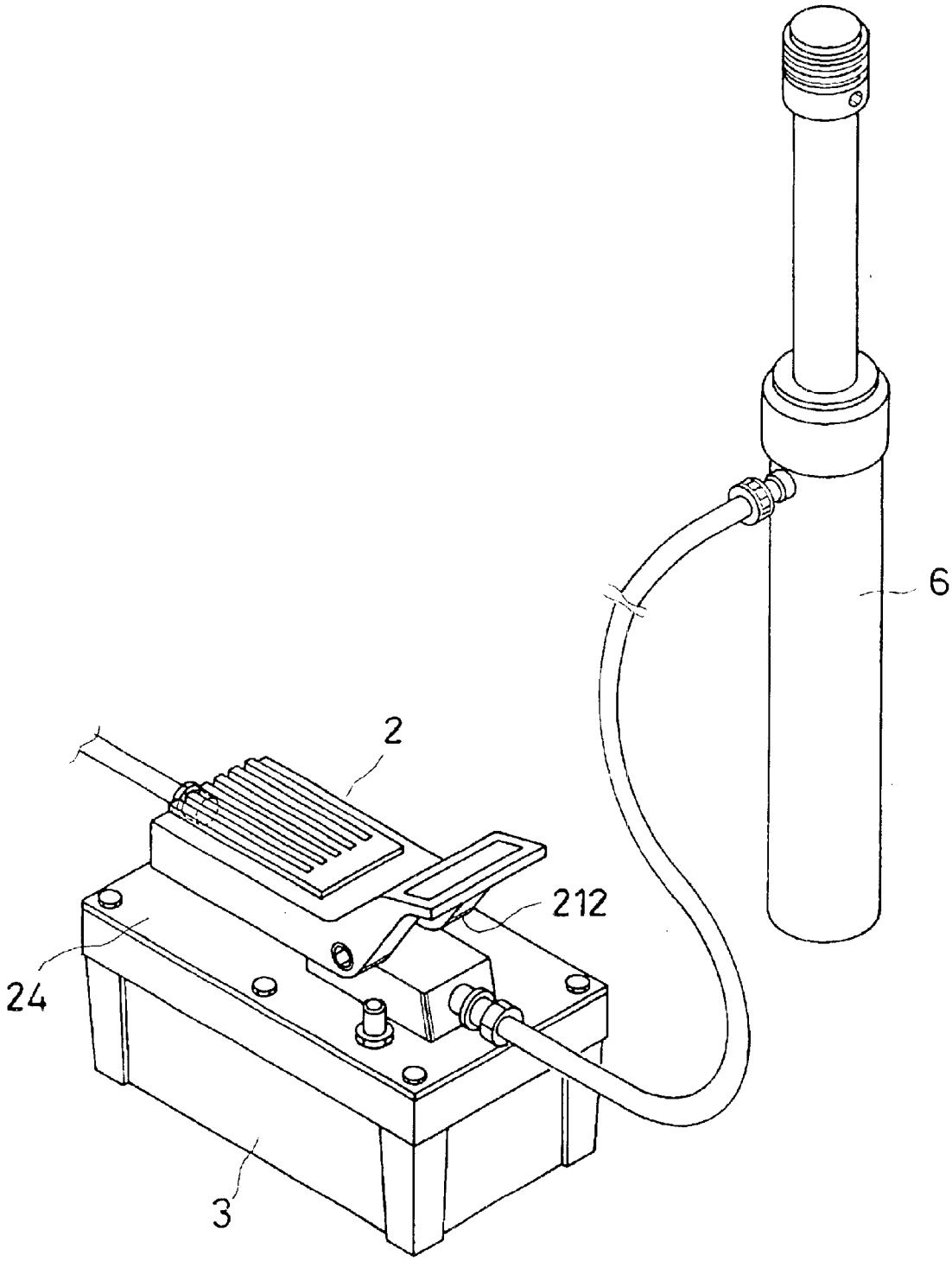
FIG. 11 is a partial cross-sectional view of the air actuated hydraulic pump working in coordination with the jack according to the present invention.

In the return stroke, the piston 135 moves leftwards until the enlarged soft poppet 143 hits the rear casting 16 thus closing the space connecting the bore 1357 of the piston 135 to the enlarged soft poppet 143. Then, pressured air from the air source 221 causes the piston 135 to move towards the front casting 11 again. Reciprocation of the piston 135 causes reciprocation of the pump piston 134 within the bore 1311, which will force oil in the bore 1311 to flow to the outlet 234 via the passage 52. The oil will be then forced to flow through the oil supplying connector 231 via the outlet 234 providing that the manual actuator 2 is not operated to depress the plunger structure 232; thus, pressured oil is supplied to other equipments connected to the oil supplying connector 231, such as a jack 6 shown in FIG. 11.

Figure 10:
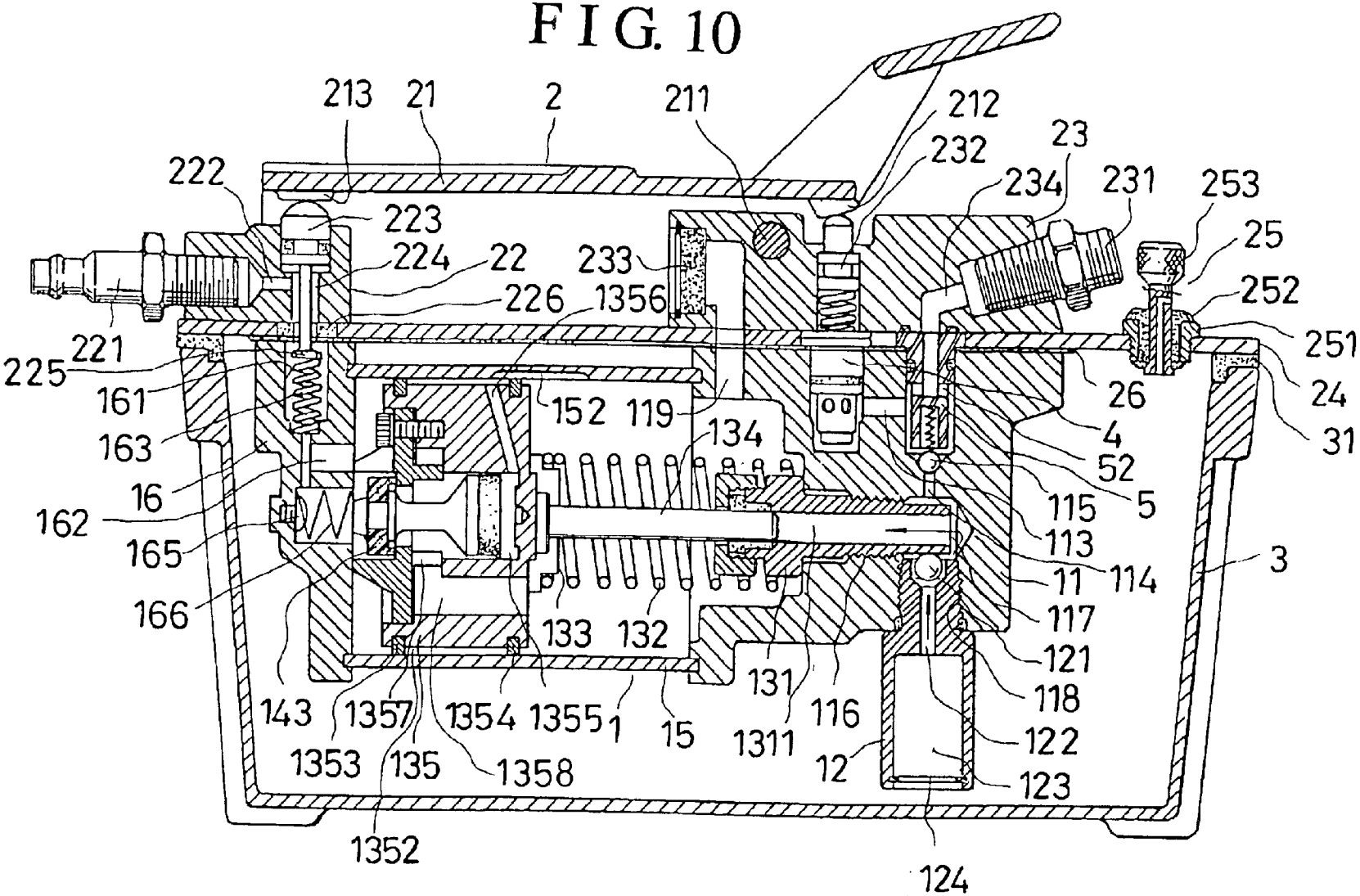
FIG. 10 is a partial cross-sectional view of the air actuated hydraulic pump working according to the present invention.

Referring to FIG. 10, when the pump piston 134 is moving forwards, the ball 121 disposed on the upper end of the hole 122 of the ball valve member 121 acts to prevent oil in the bore 1311 from flowing into the ball valve member 121. In the return stroke, the pump piston 134 will cause oil in the housing and oil reservoir 3 to flow into the bore 1311 via the filtering net 124, the straight hole 122 and the enlarged through hole 123 of the ball valve member 12.

When the manual actuator 2 is not operated, the manually actuated valve member 223 is biased upwards by the spring 163 for the valve element 225 to block the hole of the valve seat 226, and air won't travel into the rear casting 16 from the air source 221.

When the manual actuator 2 is operated so that the front tongue 212 depress the plunger structure 232, the main rod 43 of the large poppet valve member 4 is moved down, and in turn, a space will come into existence between the frusto-conical sealing surface of the main rod 43 and the valve seat member 45; thus, most oil will be forced to travel into the upper room of the valve seat member 45 via the transverse hole 113 and, the radially extending ports 451 of the valve seat member 45. Consequently, most of the oil is forced to travel into the housing and oil reservoir 3 via the recesses 453 and the conduit 53 instead of into the oil supplying connector 231.

From the above description, it can be understood that the hydraulic pump of the present invention has desirable features as following:

1. The elongated air passages 152 are formed on the inner side of the tube 15 by means of cutting with cutting machines instead of striking the inner side of the tube with pressing machines. Therefore, the roundness of the tube 15 will remain after formation of the elongated air passages 152.
2. The pilot operated guided poppet valve 14 is comprised of the separating plate 141, the enlarged soft poppet 143, and the piston ring 1422 therefore it can be easily repaired by means of replacing one of the parts that is damaged or has worn down with a new one. In other words, this form of pilot operated guided poppet valve 14 is economical to use because replacement doesn't have to be done for the whole valve 14 when only some parts of the valve 14 are damaged or have worn down.
3. The present hydraulic pump is equipped with the muffler 233 therefore noise caused by traveling of pressured air can be effectively reduced when the pump is used.
4. The present hydraulic pump is equipped with the vent valve assembly 25, which can be closed for preventing oil leakage when the hydraulic pump is transported, and opened according to the user's need.
5. The vent valve assembly 25 is easy and convenient to use, capable of being moved between the closed position and the opened position with the pull rod 253.

What is claimed is:

1. An air motor of a hydraulic pump, comprising front and rear castings disposed in a front portion and a rear portion of a housing and oil reservoir respectively;

a tube joined to the front and rear castings at opposing ends thereof, the tube having a central hole;

a piston assembly having a piston movably disposed in the central hole of the tube, the piston assembly having a pump piston connected to the piston and passed into a bore of a pump member fixedly joined to the front casting, the piston being spring biased toward the rear casting thereof;

the rear casting being connected to an air source so that pressured air of the air source can travel into the tube via the rear casting to effect reciprocating movement of the pump piston within the bore of the pump member, and being characterized by a ball valve member, and a spring loaded check valve connected to respective holes of the front casting, the ball valve member being joined to the front casting to be in one-way communication with oil containing portion of the housing and oil reservoir such that a return stroke of the pump piston effects flow of oil of the housing and oil reservoir into the bore via the ball valve member;

the spring loaded check valve being disposed in one-way communication with the bore of the pump member such that a forward stroke of the pump piston effects flow of oil contained in the bore of the pump member into an external oil supplying connector, which is joined to the spring loaded check valve and a jack at two ends, via the spring loaded check valve;

the piston assembly including a pilot operated guided poppet valve, the pilot operated guided poppet valve being movable relative to the piston to equalize pressure on opposing sides of the piston to effect a return stroke of the piston near an end of a forward stroke of the piston so that the pressured air can effect reciprocating movement of the pump piston within the bore of the pump member, the rear casting having one end of a spring extending therefrom for closing the pilot operated guided poppet valve to initiate another forward stroke.

2. An air motor of a hydraulic pump, comprising front and rear castings disposed in a front portion and a rear portion of a housing and oil reservoir respectively;

a tube joined to the front and rear castings at opposing ends thereof, the tube having a central hole;

a piston assembly having a piston movably disposed in the central hole of the tube, the piston assembly having a pump piston connected to the piston and passed into a bore of a pump member fixedly joined to the front casting, the piston being spring biased toward the rear casting thereof;

the rear casting being connected to an air source so that pressured air of the air source can travel into the tube via the rear casting to effect reciprocating movement of the pump piston within the bore of the pump member, and being characterized by a manual actuator, a ball valve member, and a spring loaded check valve; the ball valve member, and the spring loaded check valve being connected to respective holes of the front casting;

the ball valve member being joined to the front casting to be in one-way communication with an oil containing portion of the housing and oil reservoir such that a return stroke of the pump piston effects flow of oil of the housing and oil reservoir into the bore via the ball valve member, the spring loaded check valve being disposed in one-way communication with the bore of the pump member such that a forward stroke of the pump piston effects flow of oil contained in the bore of the pump member into an external oil supplying connector, which is joined to the spring loaded check valve and a jack at two ends, via the spring loaded check valve;

the manual actuator having an upwards projecting handle pivotally disposed on the housing and oil reservoir, the upwards projecting handle being capable of pivoting to a first position where a valve of an air inlet base of the manual actuator is depressed open thereby to allow pressured air of the air source to travel into the tube to effect reciprocating movement of the pump piston, the upwards projecting handle being capable of pivoting to a second position where a valve of an oil outlet base of the manual actuator is depressed open thereby to allow diversion of flow of oil from the spring loaded check valve to the oil outlet base;

the piston assembly including a pilot operated guided poppet valve, the pilot operated guided poppet valve being movable relative to the piston to equalize pressure on opposing sides of the piton to effect a return stroke of the piston near an end of a forward stroke of the piston so that the pressured air can effect reciprocating movement of the pump piston within the bore of the pump member, the rear casting having one end of a spring extending therefrom for closing the pilot operated guided poppet valve to initiate another forward stroke.

3. An air motor of a hydraulic pump, comprising front and rear castings disposed in a front portion and a rear portion of a housing and oil reservoir respectively;

a tube joined to the front and rear castings at opposing ends thereof, the tube having a central hole;

a piston assembly having a piston movably disposed in the central hole of the tube; the piston assembly having a pump piston connected to the piston and passed into a bore of a pump member fixedly joined to the front casting; the rear casting being connected to an air source so that pressured air of the air source can travel into the tube via the rear casting;

and being characterized by a pilot operated guided poppet valve of the piston assembly; the pilot operated guided poppet valve being movable relative to the piston to effect a return stroke of the piston near an end of a forward stroke of the piston so that the pressured air can effect reciprocating movement of the pump piston within the bore of the pump member;

the pilot operated guided poppet valve being comprised of a separating plate, a valve body, a piston ring, and an enlarged soft poppet in detachable connection; the separating plate being joined to the piston with screws.

* * * * *